US008191648B2

(12) United States Patent
Watanabe et al.

(10) Patent No.: US 8,191,648 B2
(45) Date of Patent: Jun. 5, 2012

(54) POWER TOOL

(75) Inventors: Masahiro Watanabe, Anjo (JP); Masanori Furusawa, Anjo (JP); Yoshihiro Kasuya, Anjo (JP)

(73) Assignee: Makita Corporation, Anjo-Shi (JP)

( * ) Notice: Subject to any disclaimer, the term of this patent is extended or adjusted under 35 U.S.C. 154(b) by 137 days.

(21) Appl. No.: 12/724,957

(22) Filed: Mar. 16, 2010

(65) Prior Publication Data

US 2010/0236800 A1 Sep. 23, 2010

(30) Foreign Application Priority Data

Mar. 23, 2009 (JP) ..... 2009-070707

(51) Int. Cl.
*B25B 23/151* (2006.01)

(52) U.S. Cl. ..... 173/20; 173/48; 173/104; 173/109

(58) Field of Classification Search ..... 173/2, 18, 173/20, 48, 104, 109, 117, 217, 162.1, 162.2
See application file for complete search history.

(56) References Cited

U.S. PATENT DOCUMENTS

| | | | | |
|---|---|---|---|---|
| 6,431,425 | B1 | 8/2002 | Moorman et al. | |
| 7,044,234 | B2 * | 5/2006 | Manschitz et al. | 173/48 |
| 7,322,427 | B2 | 1/2008 | Shimma et al. | |
| 2002/0185514 | A1 | 12/2002 | Adams et al. | |
| 2003/0037937 | A1 * | 2/2003 | Frauhammer et al. | 173/48 |
| 2006/0011361 | A1 * | 1/2006 | Shimma et al. | 173/48 |
| 2006/0185865 | A1 * | 8/2006 | Jung et al. | 173/48 |
| 2006/0185866 | A1 * | 8/2006 | Jung et al. | 173/48 |
| 2008/0017396 | A1 | 1/2008 | Kristen et al. | |
| 2009/0008111 | A1 | 1/2009 | Liebert et al. | |

FOREIGN PATENT DOCUMENTS

| | | | |
|---|---|---|---|
| EP | 1 864 761 | A1 | 12/2007 |
| EP | 2 011 606 | A2 | 1/2009 |
| GB | 2 284 377 | A | 6/1995 |
| JP | A-2006-957 | | 1/2006 |
| WO | WO 2008/136368 | A1 | 11/2008 |

OTHER PUBLICATIONS

European Search Report issued in Application No. EP 10 002 956.0; dated Jul. 15, 2010.

* cited by examiner

*Primary Examiner* — Rinaldi Rada
*Assistant Examiner* — Nathaniel Chukwurah
(74) *Attorney, Agent, or Firm* — Oliff & Berridge, PLC

(57) ABSTRACT

It is an object of the invention to easily determine a currently-selected operation mode in a power tool which offers several operation modes. A representative electric hammer drill 101 embodying a power tool according to the invention has a controller 171 for at least controlling a driving motor 111. The controller 171 includes a switch detecting circuit 173 that detects the on or off state of each of first and second switches 141, 146 when power is on, a computing/driving section 174 that determines a current operation mode based on results of detection of the switch detecting circuit 173, and a motor control section 176 and a drive circuit 177 that output a drive control signal to the driving motor 111 when the switch in the off state is turned on after the computing/driving section 174 determines the operation mode.

11 Claims, 11 Drawing Sheets

POWER TOOL

BACKGROUND OF THE INVENTION

1. Field of the Invention

The invention relates to a power tool which is capable of performing an operation on a workpiece by a tool bit.

2. Description of the Related Art

Japanese laid-open patent publication No. 2006-957 discloses an electric impact tool in which a tool bit is driven by a motor and performs a striking movement. Further, an operation mode switching mechanism is provided which can switch between first operation mode in which a first switch is allowed to be turned on by a user and a second switch is locked in an on position, and second operation mode in which the first switch is locked in an on position and the second switch is allowed to be turned on by the user.

According to the known art, when one of the switches which is not locked is turned on in each drive mode, the tool bit can be driven in the specific drive mode. It is desired in mode setting of a power tool of this type to easily determine the operation mode by detecting the on/off state of the first and second switches is further required.

SUMMARY OF THE INVENTION

It is, accordingly, an object of the invention to easily determine a currently-selected operation mode in a power tool which offers several operation modes.

Above described object can be achieved by the claimed invention. A representative power tool according to the invention offers several operation modes and includes at least a motor, a tool body, a tool bit mounting part, a handle, a first switch, a second switch and a control device. User can perform a predetermined operation by the power tool placed in the appropriate operation mode.

The tool body houses the motor. The tool bit mounting part is provided on the tool body and an elongate tool bit to be driven by the motor is coupled to the tool bit mounting part. The tool bit may be a component of the power tool or the tool body, or it may be a component separate from the power tool or the tool body. The handle is designed to be held by a user and disposed on a side of the tool body opposite from the tool bit mounting part in an axial direction of the tool bit. The first switch and the second switch can be placed in an on state or an off state. The control device serves to control the motor.

The control device includes at least a switch detecting section, an operation mode determining section and a drive control section. The switch detecting section detects the on or off state of each of the first and second switches when power is on. The state in which "power is on" widely includes the on state of the power, and such a state is typically created immediately after the power is turned on. The operation mode determining section determines a current operation mode based on results of detection of the switch detecting section. Typically, when it is detected that the first switch is on, it is determined that one operation mode is currently selected, while, when it is detected that the second switch is on, it is determined that another operation mode is currently selected. With such a construction, it can be readily determined which one of the operation modes is currently selected.

Particularly, according to this invention, by provision of the switch detecting circuit for directly detecting the on/off state of the first and second switches, an additional switch to be provided for this purpose can be rationally dispensed with. The drive control section serves to output a drive control signal to the motor when the switch in the off state is turned on after the operation mode determining section determines the operation mode. Therefore, if it is determined that the first operation mode is currently selected, the motor is driven when it is detected that the switch to be turned from the off state to the on state in the first operation mode is in the on state, while, if it is determined that the second operation mode is currently selected, the motor is driven when it is detected that the switch to be turned from the off state to the on state in the second operation mode is in the on state.

According to one aspect of the invention, the power tool preferably includes an operation mode switching member which can switch between the operation modes by manual operation of a user. The operation modes include a first hammer mode and a second hammer mode for hammering operation in which the tool bit is caused to perform linear striking movement. In the first hammer mode, by manual operation of the operation mode switching member, the second switch is held in the on state and the first switch is allowed to be turned to the on or off state. In the second hammer mode, by manual operation of the operation mode switching member, the first switch is held in the on state and the second switch is allowed to be turned to the on or off state.

With such a construction, it can be readily determined whether either the first hammer mode or the second hammer mode is currently selected among the several operation modes. If the first hammer mode is selected by manual operation of the operation mode switching member, the motor is driven when it is detected that the first switch is turned from the off state to the on state, while, if the second hammer mode is selected by manual operation of the operation mode switching member, the motor is driven when it is detected that the second switch is turned from the off state to the on state.

According to one aspect of the invention, the power tool includes an operation mode switching member which can switch between the operation modes by manual operation of a user. The operation modes include a hammer drill mode for hammer drill operation in which the tool bit is caused to perform linear striking movement and rotation in its circumferential direction. In the hammer drill mode, by manual operation of the operation mode switching member, the second switch is held in the on state and the first switch is allowed to be turned to the on or off state.

With such a construction, it can be readily determined whether the hammer drill mode is currently selected among the several operation modes. If the hammer drill mode is selected by manual operation of the operation mode switching member, the motor is driven when it is detected that the first switch is turned from the off state to the on state.

Further, according to one aspect of the invention, the operation modes preferably include a mode in which the tool bit is caused to rotate and a mode in which the tool bit is not caused to rotate, and a process of switching between these modes includes a switching process in which both of the first and second switches are placed in the off state. In this case, all or part of the process of switching between the modes can be a switching process in which both of the first and second switches are placed in the off state. With such a construction, the power tool is provided such that both of the first and second switches are placed in the off state in the process of switching between a mode in which the tool bit is caused to rotate and a mode in which the tool bit is not caused to rotate.

Further, according to one aspect of the invention, the power tool includes a first operating member which is normally biased toward an off position by a biasing means and which is depressed to an on position against a biasing force of the biasing means in order to turn on the first switch. Further, the handle has a first housing space in which the first operating member can be housed and the first operating member is housed in the first housing space in the state in which the first switch is held in the on state by manual operation of the operation mode switching member in the second hammer mode.

With such a construction, the biasing force of the biasing means can be prevented from acting upon the user via the first operating member when the first switch is held in the on state by manual operation of the operation mode switching member in the second hammer mode, so that this is effective in smoothly performing the operation.

Further, according to one aspect of the invention, the power tool preferably includes a second operating member which is repeatedly pressed with user's finger in order to turn the second switch on and off. Further, the tool body has a second housing space in which the second operating member can be housed and the second operating member is housed in the second housing space in the state in which the second switch is held in the on state by manual operation of the operation mode switching member in the first hammer mode or the hammer drill mode.

With such a construction, by visually checking whether the second operating member is housed or not, the user can readily identify the currently selected operation mode.

Further, according to one aspect of the invention, the second switch preferably comprises an electronic switch which energizes and de-energizes the motor by electric signals generated upon pressing operation of the second operating member. Specifically, this electronic switch is designed as a switch which does not have a mechanical contact for passing and interrupting motor current. With such a construction, the second switch can be reduced in size and the second operating member can be pressed with a light touch so that ease of operation is enhanced.

Further, according to one aspect of the invention, the power tool preferably includes an indicating section that indicates by illumination which one of the operation modes is currently selected. The manner of indication by the indicating section may include the manner of flashing or illuminating in a single color or multiple colors. With such a construction, the user can readily identify the currently selected operation mode via the indicating section.

Further, according to one aspect of the invention, the indicating section preferably indicates the current operation mode based on the on-off state of the second switch. The indicating section is typically designed, for example, to indicate that the second switch is in the off state, or to indicate that the second switch is in the on state, or to indicate that the second switch has been switched between the on state and the off state. With such a construction, the user can readily identify the currently selected operation mode via the indicating section based on the on-off state of the second switch.

Further, according to one aspect of the invention, the power tool preferably includes a vibration-proofing cushioning material which is disposed between the tool body and the handle and connects the tool body and the handle such that the tool body and the handle can move with respect to each other in the axial direction of the tool bit. With such a construction, the vibration-proofing cushioning material can prevent or reduce transmission of vibration from the tool body to the handle when a predetermined operation is performed by driving the tool bit. As the "vibration-proofing cushioning material" in this invention, typically, a spring or a rubber is used.

Further, according to one aspect of the invention, the power tool preferably includes a first operating member and a second operating member, and the first operating member is disposed on the tool bit mounting part side of the handle and the second operating member is disposed in a region of the tool body which faces the first operating member. The first operating member is normally biased toward an off position by a biasing means and the first operating member is depressed to an on position against a biasing force of the biasing means in order to turn on the first switch. The second operating member is repeatedly pressed with user's finger in order to turn the second switch on and off. By such arrangement of the first operating member and the second operating member which are opposed to each other, the first operating member and the second operating member can be operated by fingers of the user's hand holding the handle. Therefore, operability of the operating members for the user can be improved.

According to this invention, in a power tool which offers several operation modes, a currently-selected operation mode can be easily determined. Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved power tools, method for using such power tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
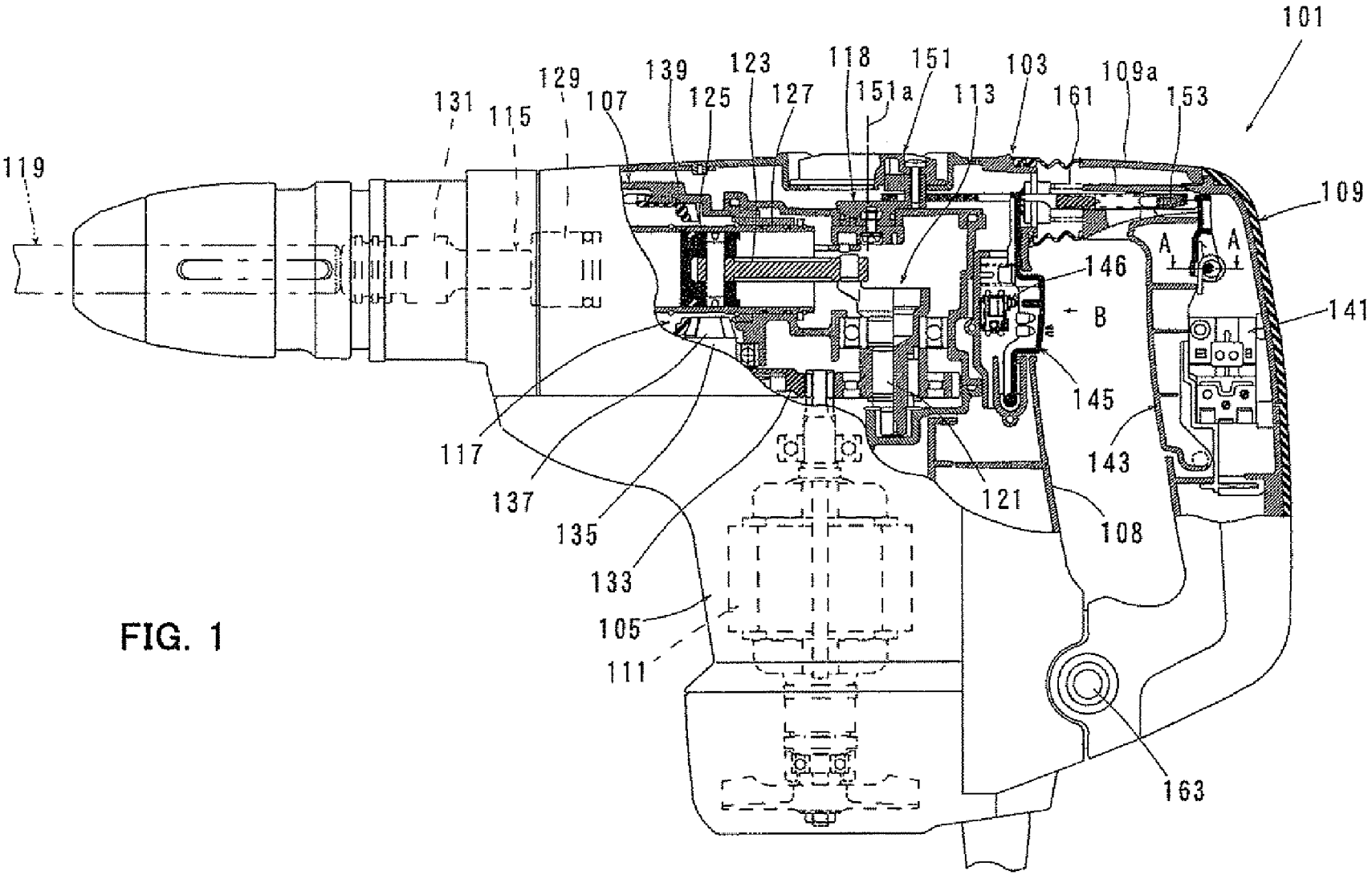
FIG. 1 is a cutaway side view showing an entire electric hammer drill according to an embodiment of the invention.

An embodiment of the invention is now described with reference to FIGS. 1 to 14. FIG. 1 shows an entire representative electric hammer drill 101 as one example of a power tool according to the invention. As shown in FIG. 1, the representative hammer drill 101 includes a body 103 that forms an outer shell of the hammer drill 101, an elongate hammer bit 119 detachably coupled to a tool holder (not shown) in a tip end region (on the left side as viewed in FIG. 1) of the body 103 in the longitudinal direction, and a handgrip 109 that is connected to the other end (right end as viewed in FIG. 1) of the body 103 in the longitudinal direction and designed to be held by a user. The body 103, the hammer bit 119 and the handgrip 109 are features that correspond to the "tool body", the "tool bit" and the "handle (to be held by a user)", respectively, according to the invention. The hammer bit 119 is mounted to the tool holder which is a feature that corresponds to a "tool bit mounting part" in this invention such that it is allowed to reciprocate with respect to the tool holder in its axial direction (the longitudinal direction of the body 103) and prevented from rotating with respect to the tool holder in its circumferential direction. For the sake of convenience of explanation, the side of a hammer bit 119 is taken as the front and the side of the handgrip 109 as the rear.

The body 103 includes a motor housing 105 that houses a driving motor 111, and a gear housing 107 that houses a motion converting mechanism 113, a striking mechanism 115 and a power transmitting mechanism 117. The driving motor 111 is a feature that corresponds to the "motor" according to this invention. The driving motor 111 is disposed such that its rotating shaft extends in a direction (vertical direction as viewed in FIG. 1) substantially perpendicular to the longitudinal direction of the body 103 (the axial direction of the hammer bit). The rotating output of the driving motor 111 is appropriately converted to linear motion by the motion converting mechanism 113 and then transmitted to the striking mechanism 115. As a result, an impact force is generated in the axial direction of the hammer bit 119 via the striking mechanism 115. Further, the speed of the rotating output of the driving motor 111 is appropriately reduced by the power transmitting mechanism 117 and then transmitted to the hammer bit 119. As a result, the hammer bit 119 is caused to rotate in the circumferential direction.

The handgrip 109 is designed as a handle to be held by a user and disposed on the side of the body 103 opposite from the tool holder in the axial direction of the hammer bit 119. The handgrip 109 is generally U-shaped in side view and extends in a vertical direction transverse to the axial direction of the hammer bit. One end (lower end) of the handgrip 109 in the vertical direction is connected to a lower portion of the rear end of the motor housing 105, and the other end (upper end) is connected to an upper portion of the rear end of a rear cover 108 which covers a rear region of the motor housing 105 and the gear housing 107, via a vibration-absorbing coil spring 161. The coil spring 161 is a feature that corresponds to the "vibration-proofing cushioning material" according to this invention. In this manner, the handgrip 109 is constructed to have a vibration-proof structure which can prevent or reduce transmission of vibration from the body 103 to the handgrip 109.

The motion converting mechanism 113 which serves to convert rotation of the driving motor 111 to linear motion and transmit it to the striking mechanism 115, is formed by a crank mechanism including a crank shaft 121 that is driven by the driving motor 111, a crank arm 12, and a piston 125. The piston 125 is a driving element that drives the striking mechanism 115 and can slide in the axial direction of the hammer bit within a cylinder 127.

The striking mechanism 115 mainly includes a striking element in the form of a striker 129 and an intermediate element in the form of an impact bolt 131. The striker 129 is slidably disposed within the bore of the cylinder 127 and linearly driven via the action of an air spring which is caused within the cylinder bore by sliding movement of the piston 125, and the impact bolt 131 is slidably disposed within the tool holder and transmits the kinetic energy of the striker 129 to the hammer bit 119.

The hammer bit 119 held by the tool holder is rotationally driven together with the tool holder via the power transmitting mechanism 117 by the driving motor 111. As shown in FIG. 1, the power transmitting mechanism 117 includes an intermediate gear 133 that is rotationally driven by the driving motor 111, an intermediate shaft 135, a first bevel gear 137 that rotates together with the intermediate shaft 135, and a second bevel gear 139 that engages with the first bevel gear 137 and rotates on a longitudinal axis of the body 103. The power transmitting mechanism 117 transmits rotation of the driving motor 111 to the tool holder and further to hammer bit 119 held by the tool holder.

A clutch, which is not shown, is disposed between the intermediate gear 133 and the intermediate shaft 135 and serves to transmit the rotating output of the driving motor 111 to the hammer bit 119 or to interrupt such transmission. The clutch is mounted such that it is fixed in the circumferential direction and slidable in the axial direction with respect to the intermediate shaft 135. The clutch can be switched by sliding along the intermediate shaft 135 between a power transmission state in which the clutch is engaged with clutch teeth of the intermediate gear 133 and a power transmission interrupted state in which such engagement is released.

The clutch can be switched by manually operating an operation mode switching dial 151 for selecting (switching) an operation mode (which is also referred to as a "drive mode") of the hammer bit 119. The operation mode switching dial 151 is a feature that corresponds to the "operation mode switching member" according to this invention. The operation mode switching dial 151 is disposed externally on the upper surface of the body 103 (above the crank mechanism) such that it can be turned in a horizontal plane around a vertical axis of rotation 151*a* extending transversely to an axis of the hammer bit 119. When the operation mode switching dial 151 is turned, the clutch of the power transmitting mechanism 117 is switched either to the power transmission state or to the power transmission interrupted state via a clutch switching mechanism 118. The clutch switching mechanism 118 is disposed within the gear housing 107 (as partly shown in FIG. 1) and serves to convert rotation of the operation mode switching dial 151 to linear motion and cause the clutch to move along the intermediate shaft 135. The clutch switching mechanism 118 is not directly related to this invention and therefore it is not described in further detail.

The operation mode is selected by turning the operation mode switching dial 151 around the rotation axis 151*a*. In this embodiment, the operation mode switching dial 151 can switch among first hammer mode, second hammer mode, hammer drill mode and neutral mode. The first hammer mode, second hammer mode, hammer drill mode and neutral mode are appropriately marked on an outer surface of the body 103 around the operation mode switching dial 151.

When the first or second mode is selected by turning the operation mode switching dial 151, the clutch of the power transmitting mechanism 117 is placed in the power transmission interrupted state by the clutch switching mechanism 118. In this state, when the driving motor 111 is driven, only the motion converting mechanism 113 is driven. The rotating output of the driving motor 111 is transmitted to the motion converting mechanism 113, and the piston 125 of the motion converting mechanism 113 is caused to reciprocate within the bore of the cylinder 127. When the piston 125 is caused to reciprocate, the motion of the piston 125 is transmitted to the hammer bit 119 via the striker 129 and the impact bolt 131 and the hammer bit 119 performs a striking movement. Thus, in the first or second mode in which the clutch is placed in the power transmission interrupted state, the hammer bit 119 performs hammering operation on a workpiece such as a concrete only by a striking movement (hammering movement).

When the hammer drill mode is selected, the clutch of the power transmitting mechanism 117 is placed in the power transmission state by the clutch switching mechanism 118. In this state, when the driving motor 111 is driven, not only the motion converting mechanism 113 but the power transmitting mechanism 117 is driven. The rotating output of the driving motor 111 is transmitted to the tool holder and the hammer bit 119 held by the tool holder via the intermediate gear 133, the clutch, the intermediate shaft 135 and the first and second bevel gears 137, 139. Thus, in the hammer drill mode in which the clutch is placed in the power transmission state, the hammer bit 119 performs hammer drill operation on a by striking movement in its axial direction and rotation in its circumferential direction (drilling movement).

An operating member (switching structure) for starting and stopping the driving motor 111 (the hammer bit 119) is now described with reference to FIGS. 6 to 9. A first operating member 143 for turning on and off a first switch 141 (for placing it in an on state or an off state) is provided on the handgrip 109 side, and a second operating member 145 for turning on and off a second switch 146 (for placing it in an on state or an off state) is provided on the body 103 side. The first switch 141 and the second switch 146 are features that correspond to the "first switch" and the "second switch", respectively, according to this invention. The first operating member 143 and the second operating member 145 are features that correspond to the "first operating member" and the "second operating member", respectively, according to this invention. The first operating member 143 is a trigger-type switch which can be operated by depressing, and the second operating member 145 is a lever-type switch which can be operated by pushing. The first operating member 143 and the second operating member 145 are opposed to each other in the fore-and-aft direction (the axial direction of the hammer bit 119) and both can be operated by fingers of the user's hand holding the handgrip 109. Therefore, the operating section can be operated by one hand, so that its operability can be improved.

The first operating member 143 is disposed in a handgrip internal space 109*b* of the hollow handgrip 109. The first operating member 143 extends in a longitudinal direction of the handgrip 109 (vertical direction transverse to the axial direction of the hammer bit 119) and is mounted to the handgrip 109 at its lower end in the extending direction by a mounting shaft 142 such that it can pivot in the fore-and-aft direction (the axial direction of the hammer bit 119). The first operating member 143 can be pivotally operated between an off position in which the first switch 141 is turned off (or "placed in the off state") and an on position in which the first switch 141 is turned on (or "placed in the on state") by depressing its upper portion by user's finger.

The first operating member 143 is normally biased away from the on position toward the off position by a spring (not shown) which is incorporated in the first switch 141 in order to hold the first switch 141 in the off state by the biasing force. The spring here is a feature that corresponds to the "biasing means" according to this invention. Therefore, in the state in which the first operating member 143 is not depressed, the upper portion of the first operating member 143 is held in the off position in which it protrudes forward through a front opening of the handgrip 109 (see FIG. 6). In the on position in which it is depressed by finger or pressed in by a slide plate 153 which is described below, the first operating member 143 is housed in the internal space 109*b* of the handgrip 109 such that its front surface is substantially flush with the outer surface of the front of the grip (see FIG. 7). The first switch 141 is designed as an automatic return type on-off switch which is biased so as to be held in the off state by the incorporated spring. The handgrip internal space 109*b* is a feature that corresponds to the "first housing space" according to this invention.

The second operating member 145 is disposed in a rear internal space 103*a* within the body 103. The rear internal space 103*a* here is a feature that corresponds to the "second housing space" according to this invention. The rear internal space 103*a* is provided as a space surrounded by the gear housing 107 and the rear cover 108 which covers a rear surface region of the gear housing 107. The second operating member 145 is a rectangular plate-like member (see FIG. 5) which is opposed to the first operating member 143 and extends in the vertical direction transverse to the axial direction of the hammer bit 119. The second operating member 145 has a shaft 145*c* on its lower end in its extending direction and can pivot in the fore-and-aft direction (the axial direction of the hammer bit 119) with the shaft 145*c* supported by a receiving member 149.

The rear region of the body 103 in which the second operating member 145 is disposed is a region remote from the hammer bit 119 and hidden when viewed from the hammer bit 119 side. Therefore, the second operating member 145 disposed in this rear region is not easily affected by dust of the which is generated during hammering or hammer drill operation, so that the dust resistance is enhanced.

Figure 6:
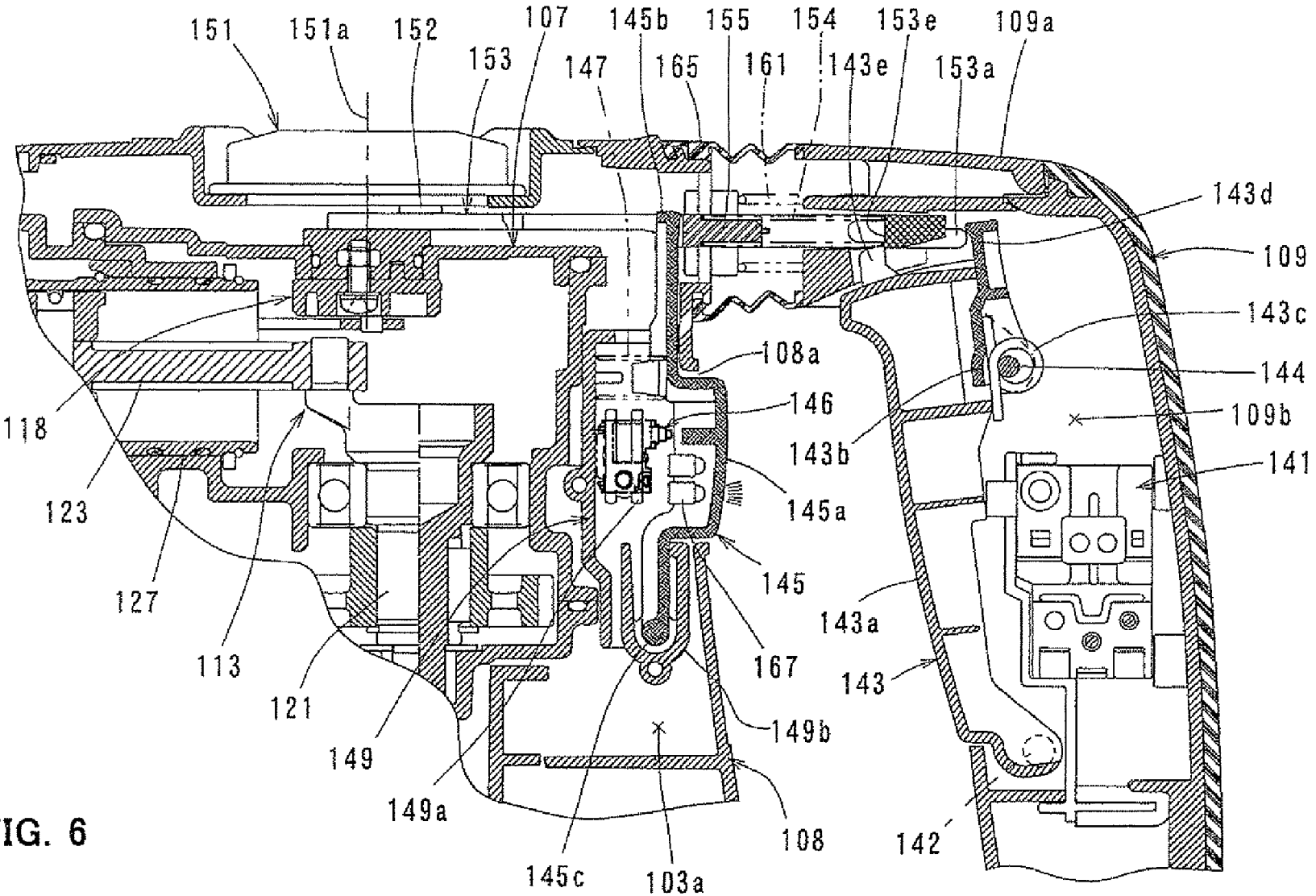
FIG. 6 is an enlarged sectional view showing operation of the slide plate which is operated by an operation mode switching dial, and first and second operating members which are operated by the slide plate, in neutral mode.
Figure 7:
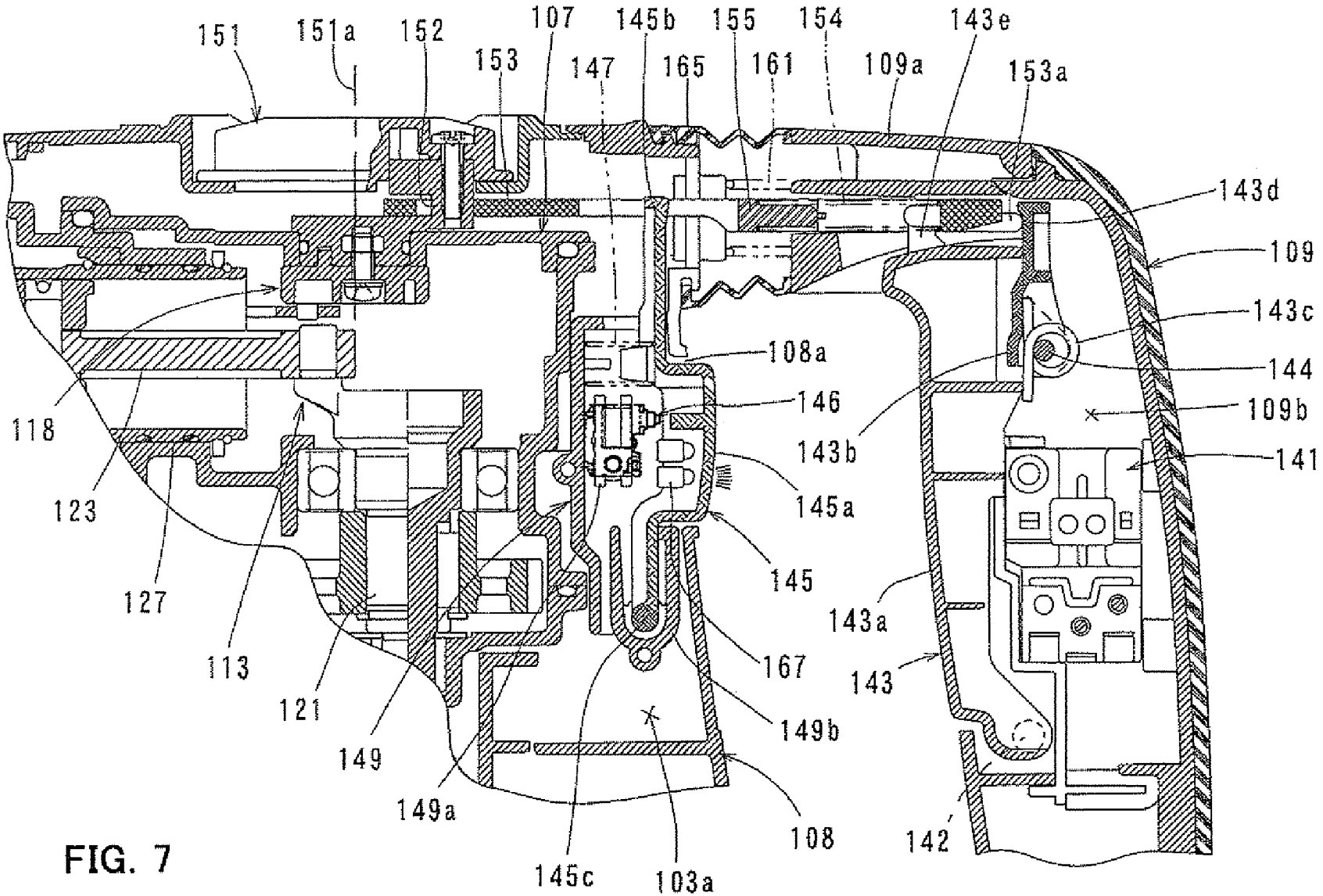
FIG. 7 is an enlarged sectional view showing operation of the slide plate which is operated by the operation mode switching dial, and the first and second operating members which are operated by the slide plate, in second hammer mode.

The second operating member 145 is pivotally operated between an off position in which it is not operated by user's finger and an on position in which it is operated by user's finger to apply a pressing force to the second switch 146. The second operating member 145 is normally biased away from the on position toward the off position by a spring 147. Further, a push button 145*a* to be pushed forward by the user's finger is formed in about the middle of the rear surface of the second operating member 145 in its extending direction. Therefore, as long as the push button 145*a* of the second operating member 145 is not pressed by user's finger, the second operating member 145 is held in the off position and the push button 145*a* protrudes rearward through an opening 108*a* of the rear cover 108. This state is shown in FIGS. 6 and 7. Further, once the second switch 146 is pressed by the second operating member 145 and turned on, the second switch 146 is held in the on state until it is pressed again.

Figure 5:
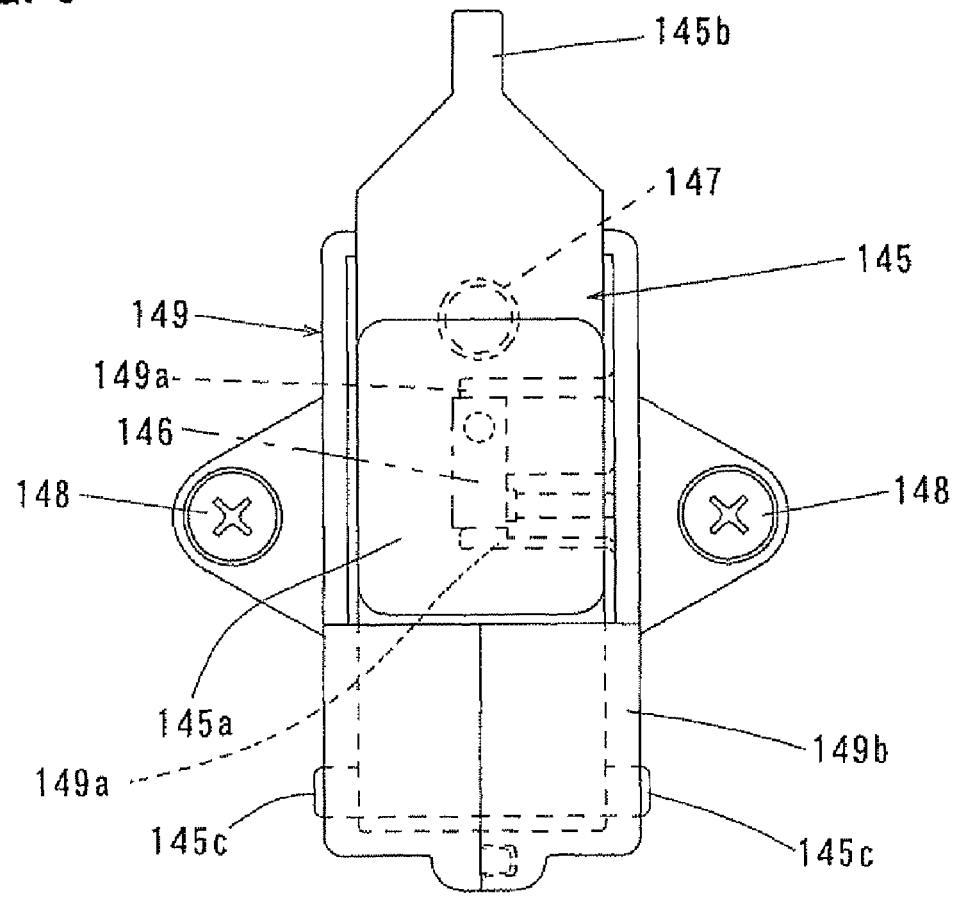
FIG. 5 is a view showing a second operating member and a receiving member as viewed from a direction of arrow B in FIG. 1.

The receiving member 149 is provided as a member for supporting the second switch 146 and the second operating member 145 and fastened to the gear housing 107 by screws 148 (see FIG. 5). The receiving member 149 has a plurality of claws 149*a* that hold the second switch 146 therebetween in the vertical direction. Further, the receiving member 149 has a generally U-shaped receiving portion 149*b* that supports the second operating member 145. Within the receiving portion 149*b*, a lower region of the second operating member 145 is housed and the shaft 145*c* is rotatably supported. Therefore, the lower region of the second operating member 145 and the generally U-shaped receiving portion 149*b* overlap each other. Due to the labyrinth effect of such a structure, the effect of preventing entry of dust into the pivot shaft receiving area of the second operating member 145 can be obtained, so that the dust resistance can be further enhanced, coupled with the above-described configuration effect of dust proofing.

Further, in the second operating member 145, at least the push button 145*a* is formed of a translucent material, and a light 167 such as a light emitting diode (LED) is disposed inside the push button 145*a*. The light 167 is turned on or off according to the position of the first operating member 143 or the second operating member 145 or to the selected operation mode, which will be described below.

Next, a slide plate 153 is explained which is provided as a switch actuating means which forcefully and selectively locks the first operating member 143 or the second operating member 145 in the on position, or releases such lock to allow it to be operated by user's finger, according to the mode selection of the operation mode switching dial 151. This slide plate 153 is shown in FIGS. 2 and 6 to 13. The slide plate 153 is linearly moved in the axial direction of the hammer bit 119 via the eccentric shaft 152 according to the turning movement of the operation mode switching dial 151 which is operated to switch the operation mode.

Figure 2:
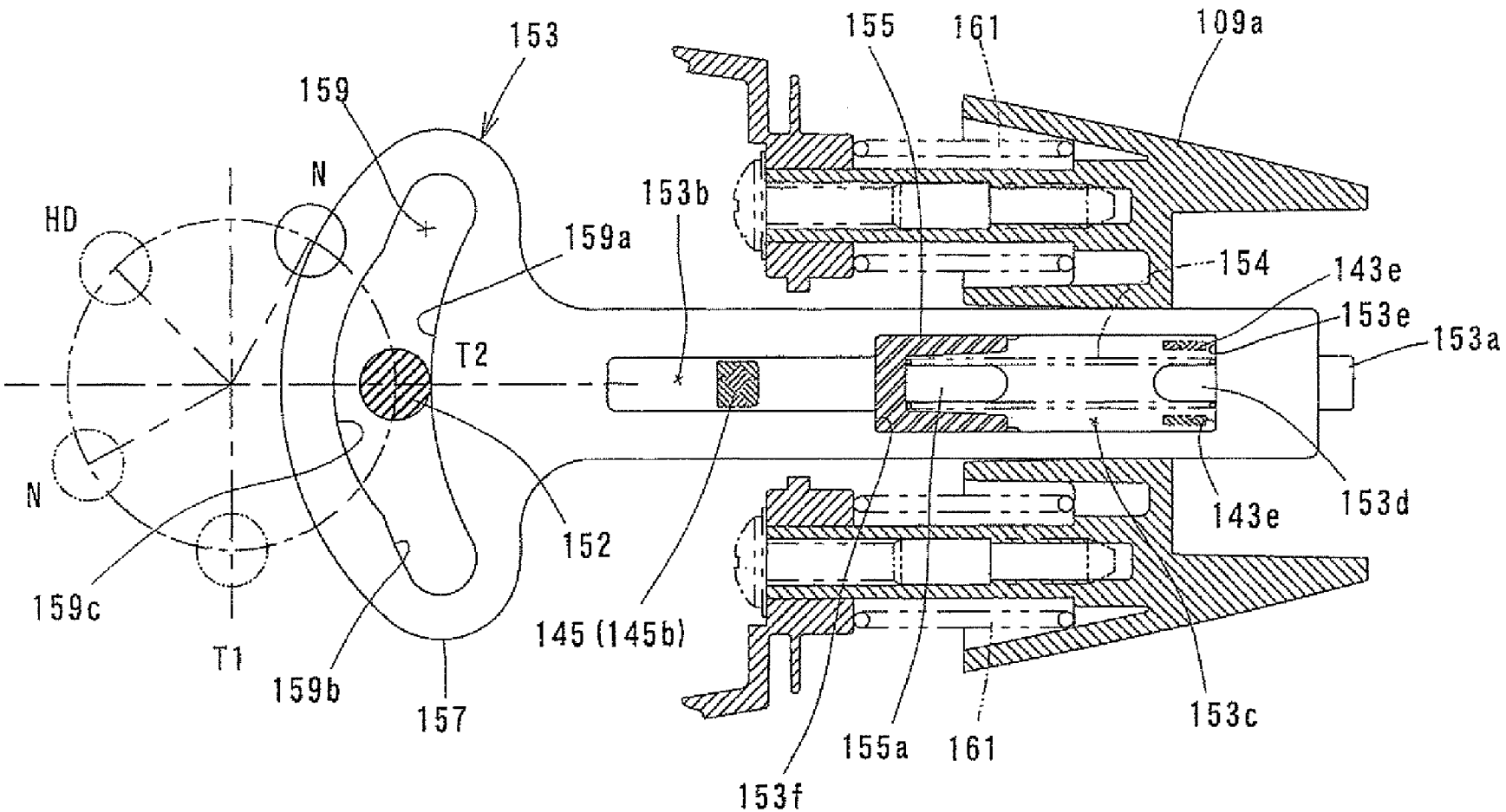
FIG. 2 is a plan view for illustrating the construction of a switch-actuating slide plate and the arrangement of the slide plate and vibration absorbing coil springs.
Figure 11:
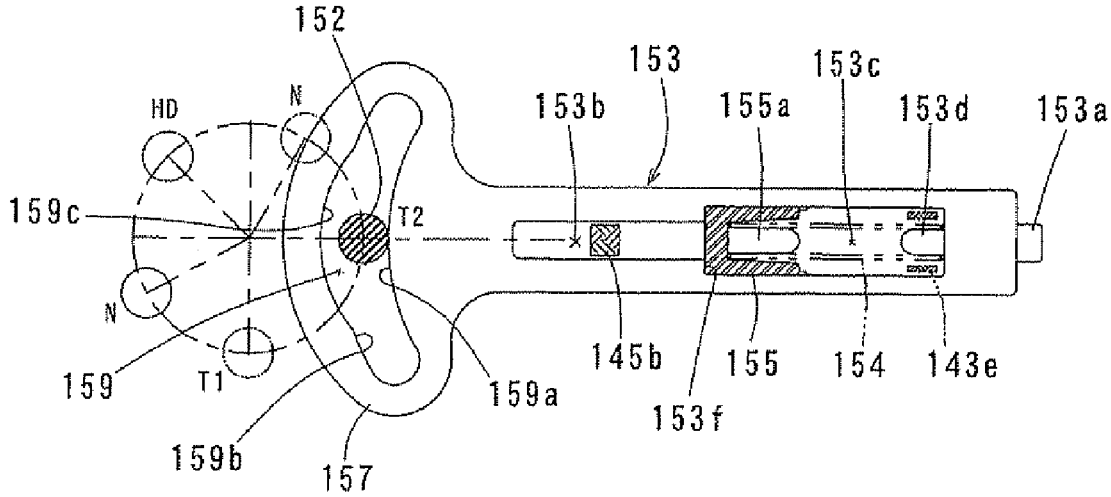
FIG. 11 is a view showing movement of the operation mode switching dial and the slide plate in second hammer mode.

As shown in FIG. 2, the slide plate 153 is an elongate member extending in the axial direction of the hammer bit 119. The slide plate 153 extends to the handgrip 109 side through an upper connecting region 109*a* of the handgrip 109 for connection with the body 103. When second hammer mode T2 is selected with the operation mode switching dial 151, the slide plate 153 is moved toward the handgrip 109 to a rear end position by an eccentric shaft 152. Thus the slide plate 153 releases the lock of the second operating member 145, while pushing the first operating member 143 rearward to the on position and locking it in the on position. This state is shown in FIGS. 2, 7 and 11. When the operation mode switching dial 151 is switched from second hammer mode T2 to first hammer mode T1 or hammer drill mode HD, the slide plate 153 is moved forward away from the handgrip 109, so that it releases the lock of the first operating member 143, while pushing the second operating member 145 forward to the on position and locking it in the on position. This state is shown in FIGS. 8, 9 12 and 13. The structure of connecting the slide plate 153 and the eccentric shaft 152 will be described below in detail.

As shown in FIG. 6, the first operating member 143 includes an operating member body 143*a* which has a generally U-shaped cross section (see FIG. 4) and is designed to be depressed by user's finger, a lever 143*b* which has a generally U-shaped cross section (see FIG. 4) and is mounted at its lower end to the operating member body 143*a* such that it can rotate on a fulcrum or pivot (mounting shaft) 144 in the direction of travel of the slide plate 153 (in the direction of pivotal movement of the operating member body 143*a*), and a vibration-absorbing torsion spring 143*c* which elastically connects the lever 143*b* to the operating member body 143*a*.

The lever 143*b* is mounted to an upper end region of the operating member body 143*a* and extends upward in such a manner as to protrude from an upper end surface of the operating member body 143*a*. An upper end portion 143*d* of the lever 143*b* faces a rear end projection 153*a* of the slide plate 153. One end of the torsion spring 143*c* is engaged with the lever 143*b* and the other end is engaged with the operating member body 143*a*, so that the torsion spring 143*c* exerts a biasing force to rotate the lever 143*b* forward. An initial load (mounting load) of the torsion spring 143*c* which is applied to the lever 143*b* upon assembly is larger than a load of fully depressing the operating member body 143*a* by user's finger (a load which is applied to the spring incorporated in the first switch 141 upon completion of the depressing operation to the on position). Therefore, when the slide plate 153 moves rearward and pushes the upper end portion 143*d* of the lever 143*b* with the rear end projection 153*a*, the lever 143*b* and the operating member body 143*a* are rotated rearward together in one piece. Specifically, the operation of the first operating member 143 to the on position by the slide plate 153 is performed with the lever 143*b* and the operating member body 143*a* held in one piece, so that such operation can be reliably preformed. Further, the maximum position limit of forward rotation of the lever 143*b* is defined by contact of the front surface of the lever 143*b* with the operating member body 143*a*.

The above-described torsion spring 143*c* is provided as an elastic member that absorbs vibration which is caused in the body 103 mainly in the fore-and-aft direction (the axial direction of the hammer bit 119) and prevents or reduces transmission of vibration from the slide plate 153 to the handgrip 109 via the first operating member 143 when a hammering operation is performed in the state in which the first operating member 143 is forcefully locked in the on position by the slide plate 153 (in second hammer mode T2).

The second operating member 145 extends upward within the rear internal space 103*a*, and an upper end 145*b* of the second operating member 145 is movably inserted into a slot 153*b* (opening) which is formed in the slide plate 153 and extends in a longitudinal direction of the slide plate 153. When the slide plate 153 is moved forward, the second operating member 145 is pushed forward to the on position by a linkage 155 which is elastically connected to the slide plate 153 via a coil spring 154 and locked in the on position.

As shown in FIG. 2, an opening 153*c* having a larger width than the slot 153*b* is formed in the slide plate 153 and extends contiguously rearward from the slot 153*b*, and the linkage 155 and the coil spring 154 are disposed within the opening 153*c*. The linkage 155 can move in the fore-and-aft direction with respect to the slide plate 153 and is biased forward by the coil spring 154 and held in a position of engagement with a stepped portion 153*f* which is formed in the boundary between the slot 153*b* and the opening 153*c*. The biasing force of the coil spring 154 is larger than the biasing force of the spring 147 which biases the second operating member 145 toward the off position. Therefore, when the slide plate 153 is moved forward, the linkage 155 moves together with the slide plate 153, and on its way, it engages with the upper end 145*b* of the second operating member 145. Thus, the linkage 155 moves the second operating member 145 to the on position and locks it in the on position. Specifically, in the state in which the second operating member 145 is forcefully locked in the on position by the slide plate 153, the second operating member 145 is elastically connected to the slide plate 153 via the coil spring 147. When the slide plate 153 is further moved forward in the state in which the second operating member 145 is forcefully locked in the on position, the linkage 155 moves with respect to the slide plate 153 while compressing the coil spring 154. Thus, the difference between the amount of travel of the second operating member 145 and the amount of travel of the slide plate 153 which is caused after engagement between the linkage 155 and the second operating member 145 can be accommodated.

Further, the coil spring 154 disposed within the slot 153*b* is loosely fitted onto a columnar guide 153*d* of the slide plate 153 and a columnar guide 155*a* of the linkage 155 which are opposed to each other, so that a stable supporting structure for the coil spring 154 can be obtained.

Next, a structure of connecting the eccentric shaft 152 of the operation mode switching dial 151 and the slide plate 153 is explained mainly with reference to FIG. 2. A connecting part 157 is formed on a front end of the slide plate 153 and has an engagement slot 159 extending in a horizontal direction (lateral direction) transverse to the direction of travel (the longitudinal direction) of the slide plate 153. The eccentric shaft 152 is loosely engaged in the engagement slot 159. The eccentric shaft 152 is disposed in a position displaced a predetermined distance from the rotation axis 151*a* of the operation mode switching dial 151. Therefore, when the operation mode switching dial 151 is turned around the rotation axis 151*a*, the eccentric shaft 152 moves the slide plate 153 in the fore-and-aft direction by the component of motion of the eccentric shaft 152 in the fore-and-aft direction (the axial direction of the hammer bit 119) while moving within the engagement slot 159 in the extending direction of the engagement slot 159 (the lateral direction). Specifically, the eccentric shaft 152 moves the slide plate 153 rearward by pushing a rear engagement surface 159*a* of the engagement slot 159, and it moves the slide plate 153 forward by pushing a front engagement surface 159*b* of the engagement slot 159. Further, when the eccentric shaft 152 is in its front end position or rear end position, the eccentric shaft 152 is centrally located within the engagement slot 159 in its extending direction.

In this embodiment, dial settings for the hammer drill mode HD, first hammer mode T1 and second hammer mode T2 are made and marked at (different) predetermined angular intervals around the rotation axis 151*a* of the operation mode switching dial 151, and neutral mode N is set and marked between the hammer drill mode HD and the first hammer mode T1 and between the hammer drill mode HD and the second hammer mode T2.

Figure 12:
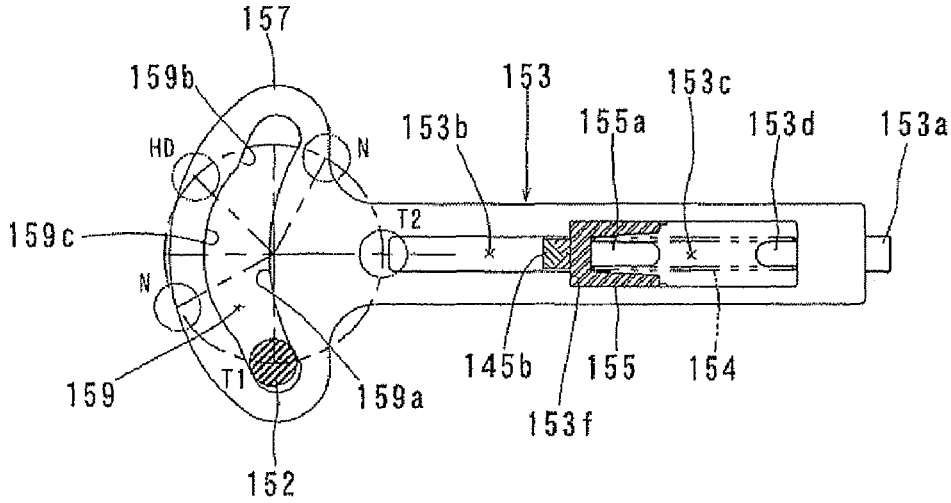
FIG. 12 is a view showing movement of the operation mode switching dial and the slide plate in first hammer mode.
Figure 13:
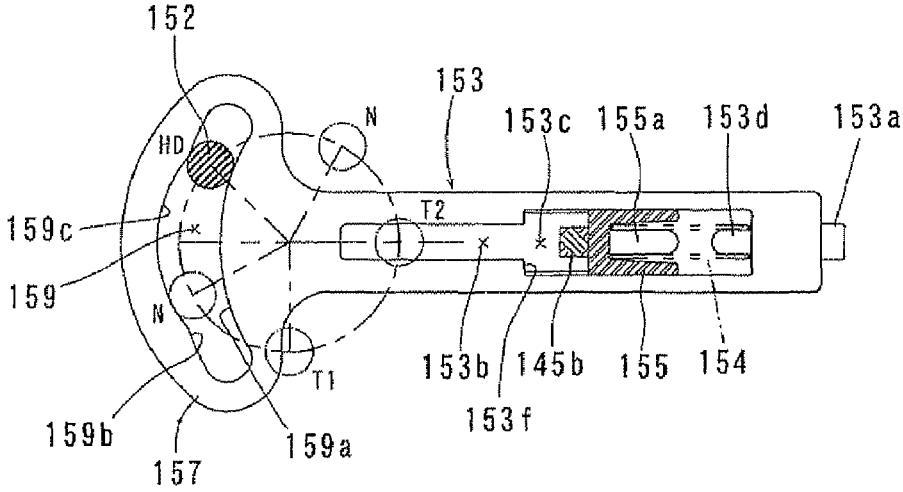
FIG. 13 is a view showing movement of the operation mode switching dial and the slide plate in hammer drill mode.

When the eccentric shaft 152 is caused to revolve rearward around the rotation axis 151*a* and the second hammer mode T2 is selected, the eccentric shaft 152 is centrally located within the engagement slot 159 (the eccentric shaft 152 is located in its rear end position). At this time, as described above, the slide plate 153 is moved to its rear end position, and the first operating member 143 is pushed rearward by the slide plate 153 and locked in the on position (see FIG. 7). When the eccentric shaft 152 is caused to revolve forward in a clockwise direction around the rotation axis 151*a* from the position of the second hammer mode T2 and the first hammer mode T1 is selected, the eccentric shaft 152 is located toward one end (lower end as shown in FIG. 12) within the engagement slot 159 in the extending direction of the engagement slot 159. When the eccentric shaft 152 is caused to revolve forward in a counterclockwise direction around the rotation axis 151*a* from the position of the second hammer mode T2 and the hammer drill mode HD is selected, the eccentric shaft 152 is located toward the other end (upper end as shown in FIG. 13). Further, when the first hammer mode T1 or the hammer drill mode HD is selected, the slide plate 153 is moved forward and the second operating member 145 is pushed forward by the slide plate 153 and locked in the on position (see FIGS. 8 and 9).

Figure 10:
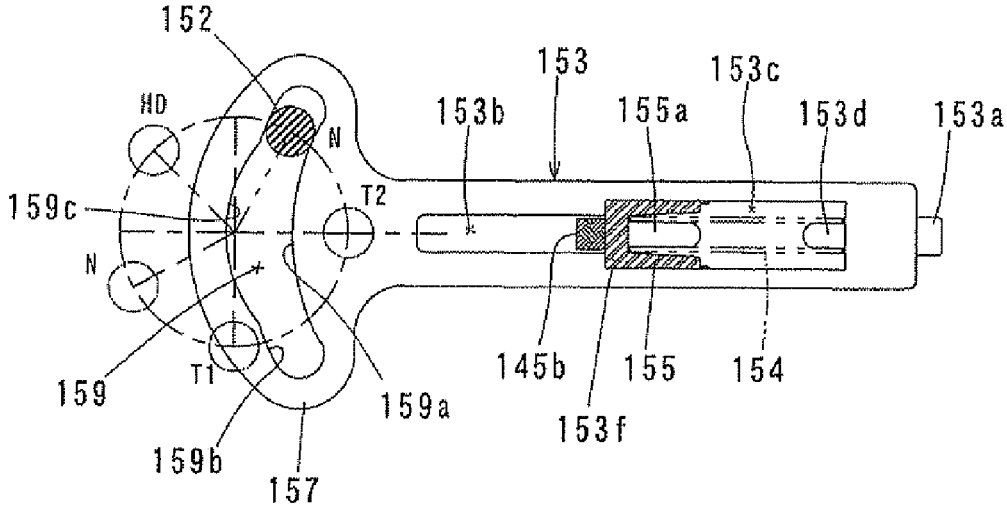
FIG. 10 is a view showing movement of the operation mode switching dial and the slide plate in neutral mode.

When the neutral mode N between the second hammer mode T2 and the hammer drill mode HD is selected, as shown in FIGS. 6 and 10, the slide plate 153 is located at about the midpoint position in the direction of travel. At this time, the rear end projection 153*a* of the slide plate 153 is disengaged from the lever 143*b* of the first operating member 143, and the linkage 155 is disengaged from the upper end 145*b* of the second operating member 145. Specifically, in the neutral mode N between the second hammer mode T2 and the hammer drill mode HD, the first operating member 143 and the second operating member 145 can be placed in the off positions. In the neutral mode N, a process of switching between the hammer drill mode HD in which the tool bit is caused to rotate and the second hammer mode T2 in which the tool bit is not caused to rotate is a switching process in which both of the first and second switches are placed in the off state. Therefore, this feature corresponds to the feature that "the operation modes include a mode in which the tool bit is caused to rotate and a mode in which the tool bit is not caused to rotate, and a process of switching between these modes includes a switching process in which both of the first and second switches are placed in the off state" according to this invention.

In this embodiment, the engagement slot 159 of the slide plate 153 has an arcuate shape curved forward toward the hammer bit 119 (arched toward the handgrip 109). Therefore, when the eccentric shaft 152 is caused to revolve, the amount of rearward travel of the slide plate 153 which corresponds to the angle of rotation of the operation mode switching dial 151 differs from the amount of travel of the component of motion of the eccentric shaft 152 in the fore-and-aft direction. Specifically, when the eccentric shaft 152 is caused to revolve from the front end position to the rear end position while pushing the convex arcuate surface or the rear engagement surface 159*a* of the engagement slot 159, the amount of rearward travel of the slide plate 153 is smaller than the amount of travel of the component of rearward motion of the eccentric shaft 152 in a forward region in which the eccentric shaft 152 moves from higher to lower areas of the convex arcuate surface (in a region in which it moves toward the position of the first hammer mode T1 and in a region in which it moves toward the position of the neutral mode N between the second hammer mode T2 and the hammer drill mode HD), while it is larger in a rearward region in which the eccentric shaft 152 moves from the lower to higher areas, i.e., in a region in which it passes the position of the first hammer mode T1 or the neutral mode N and moves toward the position of the second hammer mode T2, wherein the border between the forward and rearward regions is defined by a lateral axis intersecting with the rotation axis 151*a*. Thus, in this embodiment, when the second hammer mode T2 is selected, the amount of travel of the slide plate 153 is made larger in the rearward region. With such a construction, the amount of travel of the slide plate 153 which is required to move the first operating member 143 to the on position can be easily ensured.

Further, when the eccentric shaft 152 moves the slide plate 153 forward by pushing the concave arcuate surface or the front engagement surface 159*b* of the engagement slot 159, the amount of travel of the slide plate 153 is larger than the amount of travel of the component of forward motion of the eccentric shaft 152 in a rearward region in which the eccentric shaft 152 moves from lower to higher areas of the concave arcuate surface, while it is smaller in a forward region in which it moves from higher to lower areas of the concave arcuate surface. In other words, such is the reverse of the above-described phenomenon in rearward movement.

Further, in this embodiment, an escape recess 159*c* is formed in a central region of the front engagement surface 159*b* of the engagement slot 159 in the extending direction of its arc and recessed forward. The escape recess 159*c* is formed by a circular arc surface having a radius corresponding to the distance of displacement of the eccentric shaft 152 (the distance from the rotation axis 151*a* to the center of the eccentric shaft 152). Specifically, when the eccentric shaft 152 moves the slide plate 153 forward by pushing the front engagement surface 159*b* of the engagement slot 159, the eccentric shaft 152 is opposed to the escape recess 159*c* in the forward region or particularly in the vicinity of the end of forward movement. As a result, thereafter, further forward movement of the slide plate 153 is prevented. When the hammer drill mode HD or the first hammer mode T1 is selected, the slide plate 153 moves the second operating member 145 to the on position via the linkage 155. When the slide plate 153 is moved further forward from this position, as shown in FIG. 13, the linkage 155 pushing the second operating member 145 moves with respect to the slide plate 153 while compressively deforming the coil spring 154. Thus, the construction having the escape recess 159*c* in the front engagement surface 159*b* is effective in reducing the amount of relative movement of the linkage 155 with respect to the slide plate 153 in the vicinity of the forward end position of the slide plate 153 (in a region of switching between the hammer drill mode HD and the other neutral mode N) when the slide plate 153 is moved forward, so that undesired compressive deformation of the coil spring 154 can be reduced.

Further, a horn-like projection 143*e* is formed on the upper end of the operating member body 143*a* of the first operating member 143. When the operation mode switching dial 151 is switched to the second hammer mode T2, the slide plate 153 is moved rearward and the rear projection 153*a* of the slide plate 153 pushes the upper end portion 143*d* of the lever 143*b* so that the first operating member 143 is rotated to the on position. At this time, the projection 143*e* enters the opening 153*c* of the side plate 153. This state is shown in FIGS. 7 and 11. When the operation mode switching dial 151 is switched from the second hammer mode T2 to the hammer drill mode HD or the first hammer mode T1 and the slide plate 153 is moved forward, the projection 143*e* is engaged with a rear edge 153*e* of the opening 153*c* so that the first operating member 143 is forcefully returned to the off position.

A pair of right and left vibration-absorbing coil springs 161 are disposed in the upper connecting region 109*a* of the handgrip 109 for connection with the body 103 and elastically connect the handgrip 109 and the body 103. As shown in FIG. 2, the coil springs 161 are disposed in parallel on the opposite sides of the axis of the hammer bit 119 such that they extend and contract in the axial direction of the hammer bit 119. The slide plate 153 is disposed between the coil springs 161 on the axis of the hammer bit 119. The slide plate 153 and the coil springs 161 are covered by a rubber bellows 165.

Operation and usage of the electric hammer drill 101 constructed as described above are now described. FIGS. 6 and 10 show the state in which the neutral mode N is selected by turning the operation mode switching dial 151. In this state, the eccentric shaft 152 is located toward one end of the engagement slot 159, and the slide plate 153 is located at about the midpoint position in the direction of travel. In this state, as shown in FIG. 6, the rear end projection 153*a* of the slide plate 153 is disengaged from the lever 143*b* of the first operating member 143, and the linkage 155 of the slide plate 153 is disengaged from the upper end 145*b* of the second operating member 145. Therefore, both the first operating member 143 and the second operating member 145 are in their off positions, and both the first switch 141 and the second switch 146 are off. Thus, the driving motor 111 is held shut down.

Next, FIGS. 7 and 11 show the state in which the operation mode switching dial 151 is switched from the neutral mode N to the second hammer mode T2. In this state, rotation of the operation mode switching dial 151 is transmitted as linear motion to the clutch of the power transmitting mechanism 117 via the clutch switching mechanism 118, and the clutch is switched to the power transmission interrupted state. At the same time, the eccentric shaft 152 is caused to revolve to the rear end position and moves the slide plate 153 rearward. Then, as shown in FIG. 7, the rear end projection 153*a* of the slide plate 153 pushes the upper end portion 143*d* of the lever 143*b* of the first operating member 143 rearward. As a result, the first operating member 143 pivots around the mounting shaft 142 to the on position with the lever 143*b* and the operating member body 143*a* held in an integrally connected state by the biasing force of the torsion spring 143*e*, and thus turns on the first switch 141. Specifically, the first operating member 143 is forcefully locked in the on position by the slide plate 153.

In this state, when the push button 145*a* of the second operating member 145 is pushed forward by user's finger, the second operating member 145 pivots around the shaft 145*c* to the on position and turns on the second switch 146. Thus, the driving motor 111 is driven, and as described above, this energized state is maintained even if the second operating member 145 is released. Therefore, without need of continuing pressing the second operating member 145 by finger, the user can continuously drive the driving motor 111 to cause the hammer bit 119 to perform linear striking movement via the motion converting mechanism 113 and the striking mechanism 115 and thus can continuously perform a hammering operation on a workpiece. The second hammer mode T2 is a feature that corresponds to the "second hammer mode" according to this invention. In order to stop the hammering operation, the second operating member 145 is pressed again. Then the second switch 146 is turned off and the driving motor 111 is stopped.

Figure 3:
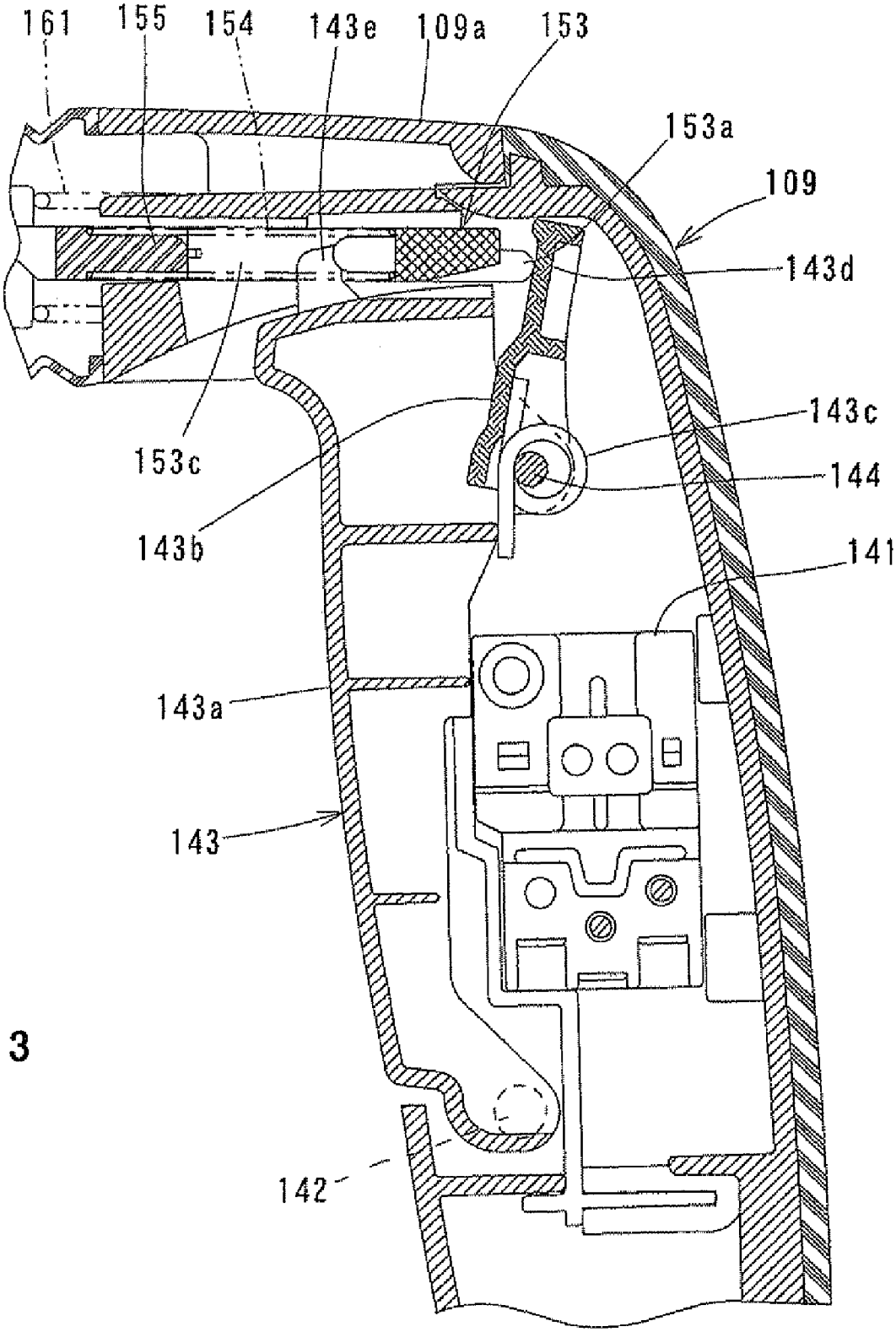
FIG. 3 is a sectional view showing the operating status of a handgrip.
Figure 4:
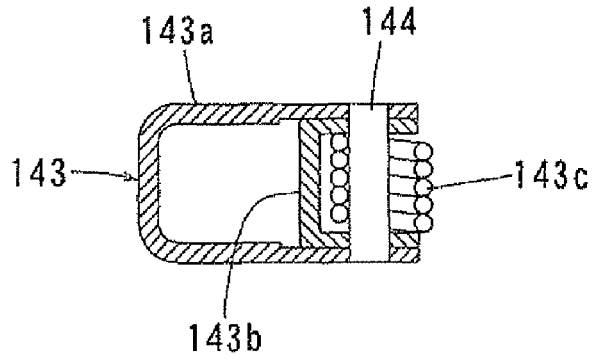
FIG. 4 is a sectional view taken along line A-A in FIG. 1.

In this case, in operation using the electric hammer drill 101, the user holds the handgrip 109 and presses the hammer bit 119 against the workpiece while applying a pressing force to the body 103 in the axial direction of the hammer bit 119. Therefore, when the hammer bit 119 is pressed against the workpiece, the handgrip 109 pivots forward toward the body 103 around a pivot 163. Then the lever 143*b* of the first operating member 143 is pushed further rearward by the slide plate 153 and pivots around the fulcrum 144 against the torsion spring 143*c* so that the front surface of the lever 143*b* is disengaged from the rear surface of the operating member body 143*a*. This state is shown in FIG. 3. Thus, the first operating member 143 is elastically connected to the slide plate 153 in the state in which it is forcefully locked in the on position by the slide plate 153. Therefore, even if the slide plate 153 vibrates together with the body 103 due to vibration caused in the body 103 during hammering operation, transmission of vibration from the slide plate 153 to the first operating member 143 can be prevented or reduced by the torsion spring 143*c*.

Figure 8:
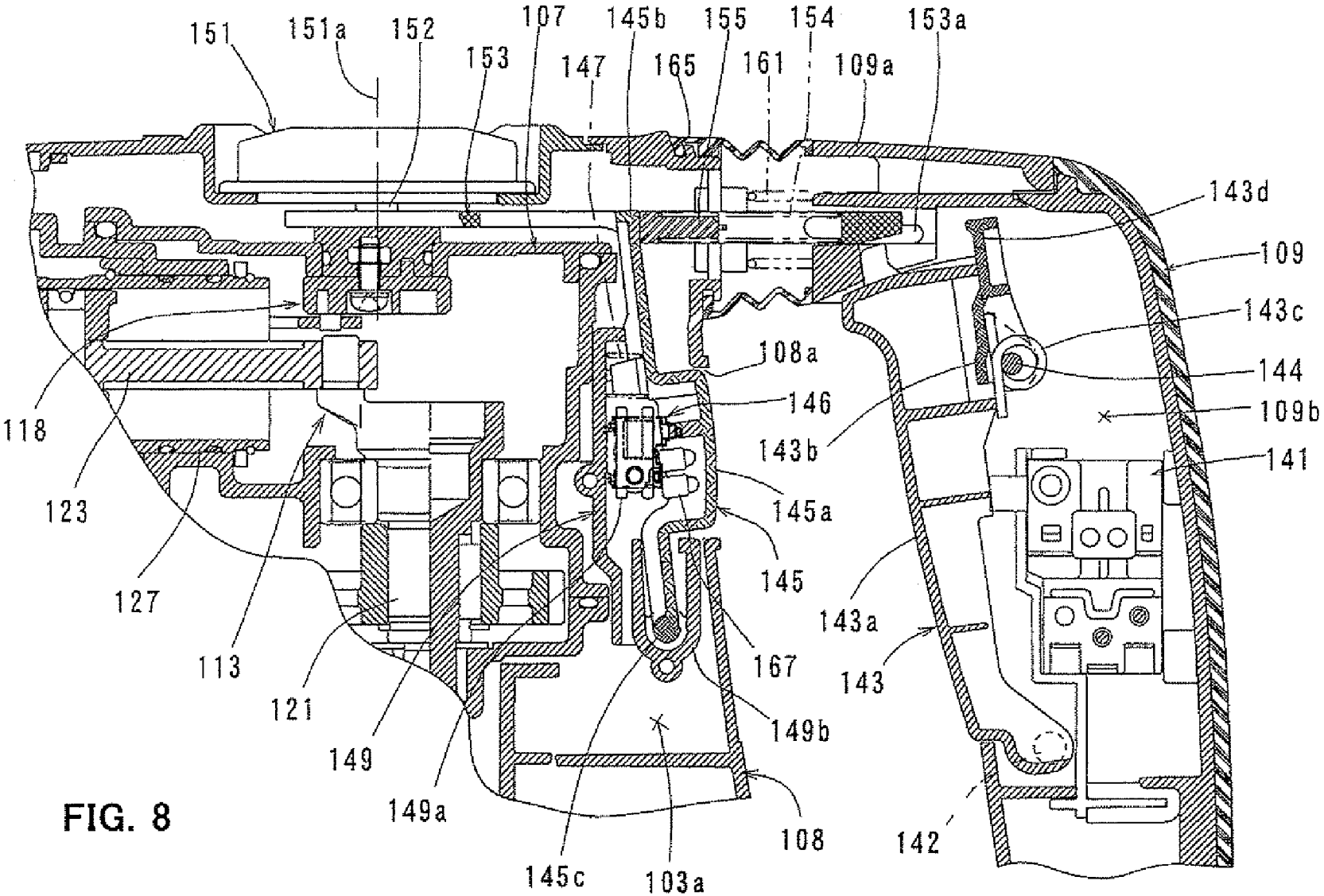
FIG. 8 is an enlarged sectional view showing operation of the slide plate which is operated by the operation mode switching dial, and the first and second operating members which are operated by the slide plate, in first hammer mode.

FIGS. 8 and 12 show the state in which the first hammer mode T1 is selected with the operation mode switching dial 151. In this state, the clutch of the power transmitting mechanism 117 is in the power transmission interrupted state. At the same time, the eccentric shaft 152 is located at about the midpoint position in its travel in the fore-and-aft direction. Thus the slide plate 153 is moved forward when viewed from its rear end position in the second hammer mode T2. Therefore, as shown in FIG. 8, the linkage 155 of the slide plate 153 is engaged with the upper end 145*b* of the second operating member 145 and pushes it forward. Then the second operating member 145 pivots forward to the on position around the shaft 145*c* and turns on the second switch 146.

By the forward movement of the slide plate 153, the rear end projection 153*a* of the slide plate 153 is disengaged from the lever 143*b* of the first operating member 143. Thus, the lock of the first operating member 143 is released and the first operating member 143 is allowed to be operated by user's finger. Therefore, the driving motor 111 is driven when the operating member body 143*a* of the first operating member 143 is depressed by user's finger to turn on the first switch 141, while the driving motor 111 is stopped when the depressing of the first switch 141 is released. In the first hammer mode T1, the clutch of the power transmitting mechanism 117 is in the power transmission interrupted state, so that the hammer bit 119 performs only linear striking movement when the driving motor 111 is driven. Thus, in the first hammer mode T1, the user can arbitrarily start and stop the driving motor 111 by operating the first operating member 143 by finger in order to intermittently (sporadically) perform a hammering operation on a workpiece by the hammer bit 119. The first hammer mode T1 is a feature that corresponds to the "first hammer mode" according to this invention.

Figure 9:
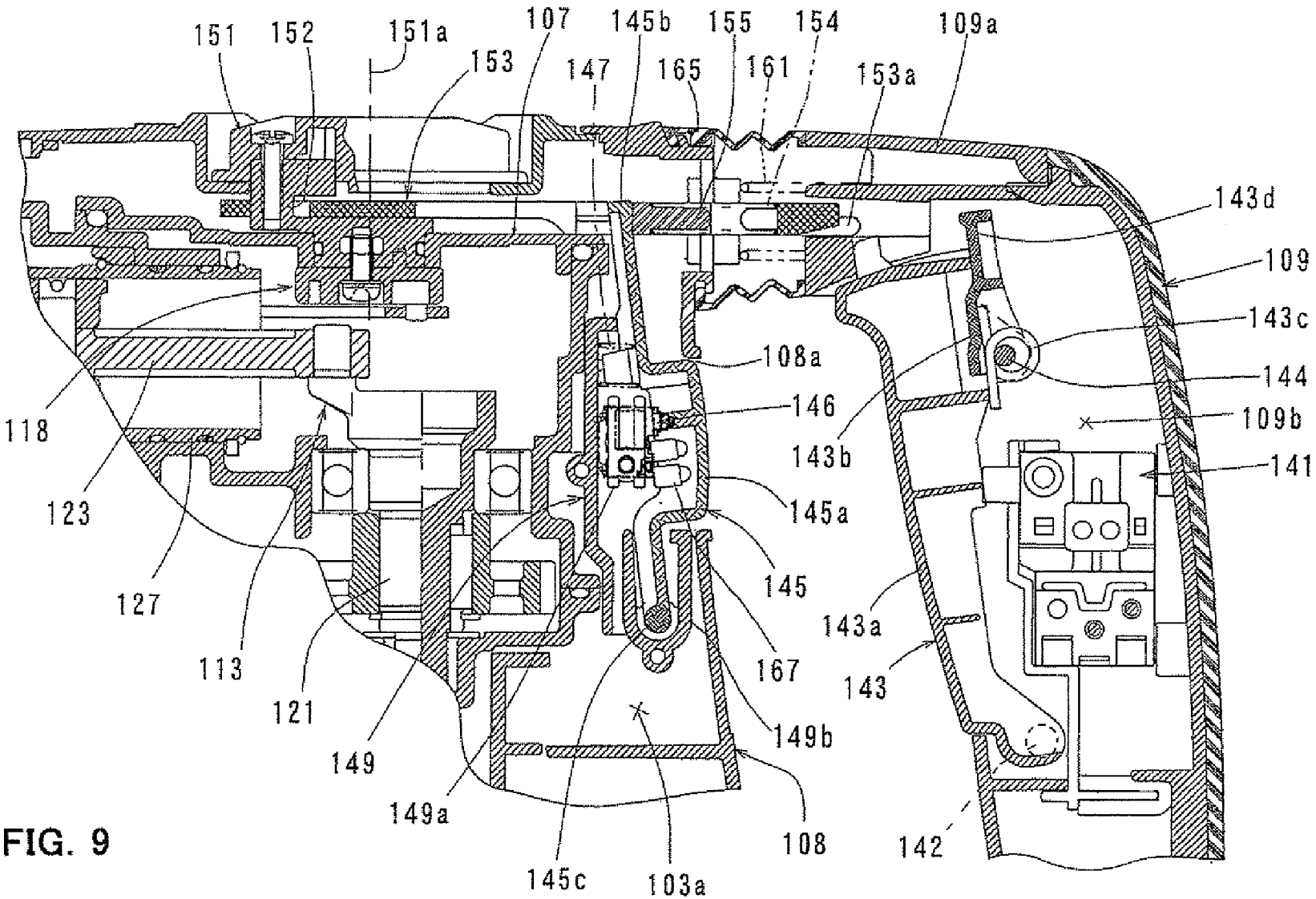
FIG. 9 is an enlarged sectional view showing operation of the slide plate which is operated by the operation mode switching dial, and the first and second operating members which are operated by the slide plate, in hammer drill mode.

FIGS. 9 and 13 show the state in which the hammer drill mode HD is selected with the operation mode switching dial 151. In this state, the clutch of the power transmitting mechanism 117 is placed in the power transmission state. At the same time, the eccentric shaft 152 is revolved further forward than in the first hammer mode T1. Thus, as shown in FIG. 13, the slide plate 153 is moved forward by the eccentric shaft 152, but the linkage 155 is prevented from moving further forward when the second operating member 145 reaches its on position. Therefore, the linkage 155 which is connected to the slide plate 153 via the coil spring 154 moves with respect to the slide plate 153 while compressively deforming the coil spring 154. Thus, the difference between the amount of travel of the second operating member 145 and the amount of travel of the slide plate 153 is accommodated. When the second operating member 145 is pivoted to the on position, the second switch 146 is turned on.

Further, by the forward movement of the slide plate 153, like in the first hammer mode T1, the rear end projection 153*a* of the slide plate 153 is disengaged from the lever 143*b* of the first operating member 143, so that the first operating member 143 is allowed to be arbitrarily operated by user's finger. Further, in the hammer drill mode HD, the clutch of the power transmitting mechanism 117 is placed in the power transmission state via the clutch switching mechanism 118. Therefore, in the hammer drill mode HD, the user can arbitrarily start and stop the driving motor 111 by operating the first operating member 143 by finger. Thus the user can intermittently (sporadically) perform a hammer drill operation on a workpiece by linear striking movement of the hammer bit 119 and its rotation in its circumferential direction. The hammer drill mode HD is a feature that corresponds to the "hammer drill mode" according to this invention.

Figure 14:
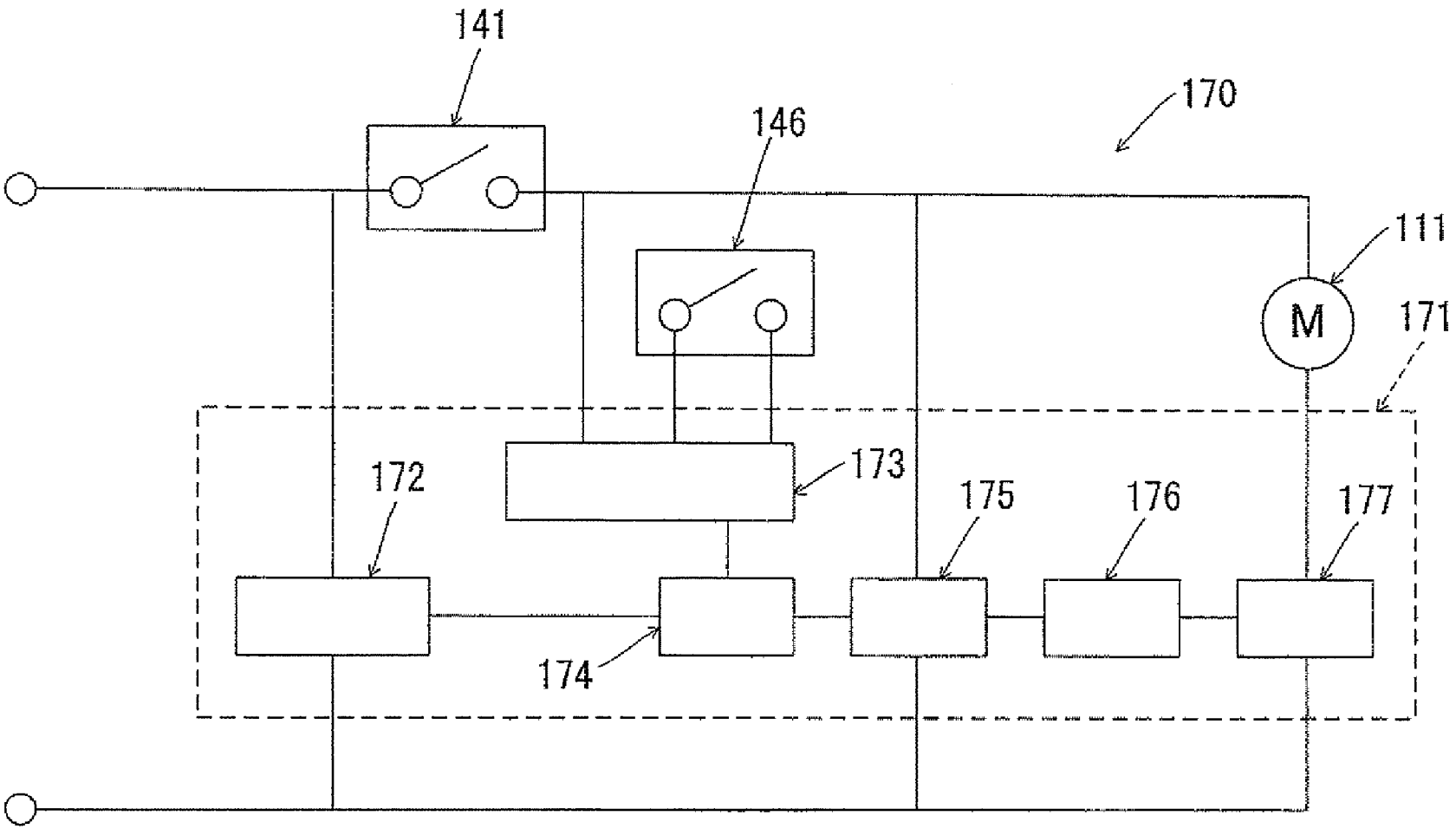
FIG. 14 is a circuit diagram of a control circuit 170 in this embodiment.

Now, a control circuit 170 of the electric hammer drill 101 according to this embodiment is explained with reference to FIG. 14. FIG. 14 is a circuit diagram of the control circuit 170 in this embodiment. The control circuit 170 is formed by a controller 171 as well as the above-described driving motor 111 and first and second switches 141, 146.

The controller 171 is a control device for at least controlling the driving motor 111 and includes a circuit power supply section 172, a switch detecting circuit 173, a computing/driving section 174, a motor control circuit power supply section 175, a motor control section 176, and a drive circuit 177. The controller 171 is a feature that corresponds to the "control device" according to this invention.

The circuit power supply section 172 is designed as a section for supplying external power to the switch detecting circuit 173 and the computing/driving section 174. The switch detecting circuit 173 is designed to detect whether each of the first switch 141 and the second switch 146 is in the on position or in the off position. Specifically, the switch detecting circuit 173 serves to detect the on/off state of the first and second switches 141, 146. The switch detecting circuit 173 here is a feature that corresponds to the "switch detecting section" according to this invention.

The computing/driving section 174 includes a computing part for computing based on information detected in the switch detecting circuit 173, and a driving part for driving a motor control circuit according to the computation. Particularly, the computing part of the computing/driving section 174 executes at least processing for determining the mode of operation of the hammer bit 119 according to the on/off state of the first and second switches 141, 146 when the power is on. The state in which the "power is on" herein widely includes the on state of the power, and such a state is typically created immediately after the power is turned on. Specifically, the computing/driving section 174 serves to determine the operation mode based on the results of detection of the switch detecting circuit 173. The computing/driving section 174 here is a feature that corresponds to the "operation mode determining section" according to this invention.

The motor control circuit power supply section 175 is designed as a section for supplying external power to the motor control circuit. The motor control section 176 and the drive circuit 177 form a mechanism for controlling drive of the driving motor 111. The motor control section 176 and the drive circuit 177 form the "drive control section" according to this invention.

In the controller 171 having the above-described construction, the computing/driving section 174 determines whether the hammer drill 101 is placed in first operation mode (the above-described second hammer mode T2) or in second operation mode (the above-described first hammer mode T1 or hammer drill mode HD), based on the results of detection of the switch detecting circuit 173. With such a construction, it can be readily determined which one of the operation modes is currently selected. Particularly, by provision of the switch detecting circuit 173 for directly detecting the on/off state of the first and second switches 141, 146, an additional switch to be provided for this purpose can be rationally dispensed with.

Next, the first to fourth determinations on the hammer drill 101 by the computing/driving section 174 are described.

(First Determination)

If the switch detecting circuit 173 detects that the first switch 141 is in the on position and the second switch 146 is in the off position when the power is turned on, it is determined that the hammer drill 101 is placed in the first operation mode (first determination). In the first operation mode, the first switch 141 is locked in the on position, and on-off operation of the second switch 146 is enabled. Based on the first determination, the controller 171 outputs a drive control signal to the driving motor 111 when the second switch 146 is turned from the off position to the on position after determination of the operation mode. Thus the driving motor 111 is started. Further, in this embodiment, as the second switch 146, particularly an electronic switch may be used which energizes and de-energizes the driving motor 111 by electric signals generated upon pressing operation of the second operating member 145. By using such an electronic switch, the energized state of the driving motor 111 can be continued with one click. This electronic switch is designed as a switch which does not have a mechanical contact for passing and interrupting motor current of the driving motor 111. By provision of such an electronic switch, the second switch 146 can be reduced in size and the second operating member 145 can be pressed with a light touch so that ease of operation is enhanced. In the first operation mode, the driving motor 111 is stopped when the second switch 146 is placed in the off position after the driving motor 111 is started.

(Second Determination)

If the switch detecting circuit 173 detects that the first switch 141 is in the off position and the second switch 146 is in the on position when the power is turned on, it is determined that the hammer drill 101 is placed in the second operation mode (second determination). In the second operation mode, the second switch 146 is locked in the on position, and on-off operation of the first switch 141 is enabled. Based on the second determination, the controller 171 outputs a drive control signal to the driving motor 111 when the first switch 141 is turned from the off position to the on position after determination of the operation mode. Thus the driving motor 111 is started.

(Third Determination)

If the switch detecting circuit 173 detects that both the first switch 141 and the second switch 146 are in the on position when the power is turned on, it is determined that the hammer drill 101 is not in normal conditions (third determination). Specifically, in this timing before starting an operation of the hammer drill, the condition in which both of the first and second switches 141, 146 are in the on position means that a switch is left on, for example, due to user's misoperation or dust deposition, or the switch is faulty. Therefore, in the case of the third determination, even if both of the first and second switches 141, 146 are in the on position, the controller 171 disables driving of the driving motor 111.

At this time, preferably, it is controlled to inform the user of the abnormal condition, for example, by using a warning lamp. Further, it is preferable to indicate by illumination which one of the operation modes is currently selected. In this embodiment, a light 167 is provided as the illumination and designed to indicate an abnormal condition when both of the first and second switches 141, 146 are in the on position. The light 167 herein is a feature that corresponds to the "indicating section" according to this invention. With such a construction, the user can easily identify the current operation mode indicated by the light 167 based on the on-off state of the second switch 146. The indication by the light 167 can be realized by flashing or illuminating in a single color or multiple colors. The light 167 may be designed as necessary, for example, to indicate that the second switch 146 is in the off state, or to indicate that the second switch 146 is in the on state, or to indicate that the second switch 146 has been switched between the on state and the off state. Thereafter, when either the first switch 141 or the second switch 146 is placed in the on position, the above-described first or second operation mode is entered.

(Fourth Determination)

If the switch detecting circuit 173 detects that both of the first and second switches 141, 146 are in the off position when the power is turned on, it is determined that the hammer drill 101 is placed in the neutral mode between the above-described second hammer mode T2 and hammer drill mode HD (fourth determination). In this neutral mode, driving of the driving motor 111 is disabled. Thereafter, when either the first switch 141 or the second switch 146 is turned from this neutral mode to the on position, the above-described first or second operation mode is entered.

It is essential for the computing/driving section 174 to make a determination based on detection of the switch detecting circuit 173 at least when the power is in the on state. Therefore, the determination may be made when the power is turned on as described above, or it may be made at an appropriate time, for example, after completion of normal operation of the hammer drill.

The electric hammer drill 101 according to this embodiment has the vibration-proof handgrip 109 having the lower end connected to the body 103 such that it can rotate on the pivot 163 in the fore-and-aft direction and having the upper end connected to the body 103 via the vibration-absorbing coil springs 161. Therefore, during hammering or hammer drill operation, transmission of vibration particularly in the axial direction of the hammer bit 119 from the body 103 to the handgrip 109 can be reduced by the coil springs 161.

During operation in the second hammer mode T2, as described above, the first operating member 143 on the handgrip 109 side is forcefully locked in the on position by the slide plate 153 on the body 103 side. Therefore, if the connection between the body 103 and the handgrip 109 is made by a rigid structure, vibration on the body 103 side will be transmitted from the slide plate 153 to the handgrip 109 via the first operating member 143.

Therefore, in this embodiment, the first operating member 143 is formed by the operating member body 143*a* and the lever 143*b* which are connected by the torsion spring 143*c*, so that transmission of vibration from the slide plate 153 to the first operating member 143 is absorbed by utilizing elastic deformation of the torsion spring 143*c* (see FIG. 3). Specifically, according to this embodiment, with such a construction, the vibration-proofing structure of the first operating member 143 is rationally provided on the first operating member 143 side. Thus, the mode selecting function of selecting the operation mode between the second hammer mode T2 in which the first operating member 143 is forcefully locked in the on position and the first hammer mode T1 and hammer drill mode HD in which the first operating member 143 can be arbitrarily operated by the user and the function of proofing vibration of the handgrip 109 by connecting the handgrip 109 to the body 103 via the coil springs 161 can be simultaneously realized.

In this case, in this embodiment, the initial load of the torsion spring 143*c* which is applied to the lever 143*b* upon assembly is designed to be larger than a load which is applied to the built-in off-position biasing spring in the first switch 141 when the operating member body 143*a* is placed in the on position to turn on the switch 141. Therefore, in the second hammer mode T2, the first operating member 143 can be reliably locked in the on position, and the effect of reducing vibration transmission by the torsion spring 143*c* can be obtained.

In any operation mode other than the second hammer mode T2 of continuously performing hammering operation, the forceful lock of the first operating member 143 in the on position by the slide plate 153 is released. Therefore, transmission of vibration from the body 103 to the handgrip 109 can be reduced by the coil springs 161 which connect the handgrip 109 and the body 103. In other words, from another viewpoint, in the electric hammer drill 101 according to this embodiment, the function of reducing vibration of the handgrip 109 is performed by both the coil springs 161 and the torsion spring 143*c* in the second hammer mode T2, while it is performed only by the coil springs 161 in the other operation modes. Specifically, the vibration-proofing spring load of the handgrip 109 in the second hammer mode T2 is different from that in the other operation modes. Therefore, with such a construction, both the operation mode selecting function and the vibration-proof handgrip 109 can be simultaneously realized.

Further, in this embodiment, in the first hammer mode T1 or the hammer drill mode HD, the switch-actuating slide plate 153 for pushing the second operating member 145 to the on position is designed to perform such pushing operation via the linkage 155 which is elastically connected to the slide plate 153 via the coil spring 154. Therefore, the difference between the amount of travel of the second operating member 145 and the amount of travel of the slide plate 153 is accommodated by relative movement of the linkage 155 with respect to the slide plate 153. Thus, the amount of travel of the second operating member 145 and the amount of travel of the slide plate 153 can be arbitrarily and individually set, so that higher freedom of design is obtained.

Further, the first operating member 143 is housed in the internal space 109*b* (first housing space) of the handgrip 109 when it is pushed by the slide plate 153 to the on position in the second hammer mode T2. This construction is a feature that corresponds to the construction in which "the handle has a first housing space in which the first operating member can be housed, and the first operating member is housed in the first housing space in the state in which the first switch is held in the on state by manual operation of the operation mode switching member in the second hammer mode" according to this invention. Further, the second operating member 145 is housed in the rear internal space 103*a* (second housing space) within the body 103 when it is pushed by the slide plate 153 to the on position in the first hammer mode T1 or the hammer drill mode HD. This construction is a feature that corresponds to the construction in which "the tool body has a second housing space in which the second operating member can be housed and the second operating member is housed in the second housing space in the state in which the second switch is held in the on state by manual operation of the operation mode switching member in the first hammer mode or the hammer drill mode".

Therefore, by visually checking whether the first and second operating members 143, 145 are housed or not, the user can distinguish whether the currently-selected mode is the second hammer mode T2 for continuous operation, or the first hammer mode T1 or hammer drill mode HD for intermittent operation. Further, such a structure of housing the operating sections can prevent the biasing force of the spring (biasing means) from acting upon the user via the first operating member 143 or the second operating member 145, so that this is effective in smoothly performing the operation.

The first operating member 143 and the second operating member 145 are opposed to each other, so that they can be operated by the one hand holding the handgrip 109. Further, the rear end region of the body 103 in front of the handgrip 109 is a region remote from the hammer bit 119 and hidden when viewed from the hammer bit 119 side. Therefore, this rear region is not easily affected by dust of the which is generated during hammering or hammer drill operation, so that the dust resistance is enhanced.

Further, in this embodiment, the vibration-absorbing coil springs 161 are disposed on the opposite sides of the axis of the hammer bit 119, and the slide plate 153 is disposed between the coil springs 161. In operation using the electric hammer drill 101, the user holds the handgrip 109 and presses the hammer bit 119 against the workpiece while applying a pressing force to the body 103 in the axial direction of the hammer bit 119. Therefore, by the above-described arrangement of the coil springs 161 on the opposite sides of the axis of the hammer bit 119, stability of the handgrip 109 can be achieved during operation with the hammer bit 119 pressed against the workpiece. Further, by the arrangement of the slide plate 153 between the coil springs 161, a rationally arranged structure can be obtained.

Further, the invention is not limited to the above-described embodiments, but may be appropriately modified or changed. In the above embodiments, the first operating member 143 is connected to the slide plate 153 via an elastic member in the state in which the first operating member 143 is forcefully locked in the on position by the slide plate 153, and the vibration proofing torsion spring 143*c* is provided on the first operating member 143. As alternatives to this construction, however, an elastic member such as a spring and rubber may be provided between the slide plate 153 and the first operating member 143, or an elastic member may be mounted on the slide plate 153. The structure of mounting an elastic member on the slide plate 153 can be realized, for example, by provision of the construction in which the pushing member of the first operating member 143 is connected to the rear region of the slide plate 153 via the elastic member such that it can move with respect the slide plate 153 in the fore-and-aft direction.

Further, in the present embodiment, in the structure of connecting the eccentric shaft 152 of the operation mode switching dial 151 and the slide plate 153, the engagement slot 159 is arcuately shaped in order to create a difference between the amount of travel of the slide plate 153 and the amount of travel of the component of motion of the eccentric shaft 152 in the fore-and-aft direction. Alternatively, however, the engagement slot 159 may be shaped to extend linearly in a direction transverse to the fore-and-aft direction. Further, it may be designed such that the selection of the operation mode is made not by turning motion but by linear motion. Further, in this embodiment, the drive modes of the hammer bit 119 is described as including the first hammer mode T1, the second hammer mode T2 and the hammer drill mode HD. In addition to these modes, however, it may be constructed to offer a drill mode in which the hammer bit 119 is caused to perform only rotation.

Further, in the present embodiment, the second operating member 145 is designed to automatically return to the off position when it is released after pushed to the on position. It may however be designed like the second switch 146 to remain in the on position even if it is pushed and then released and to return to the off position when it is pushed again (next time).

Further, in the present embodiment, the electric hammer drill 101 is explained as a representative example of the power tool, but it can also be applied to a hammer in which the hammer bit 119 is caused to perform only a striking movement.

DESCRIPTION OF NUMERALS

101 electric hammer drill (power tool)
103 body (tool body)
103*a* rear internal space
105 motor housing
107 gear housing
108 rear cover

108*a* opening
109 handgrip
109*a* upper connecting region
109*b* handgrip internal space
111 driving motor
113 motion converting mechanism
115 striking mechanism
117 power transmitting mechanism
118 clutch switching mechanism
119 hammer bit (tool bit)
121 crank shaft
123 crank arm
125 piston
127 cylinder
129 striker
131 impact bolt
133 intermediate gear
135 intermediate shaft
137 first bevel gear
139 second bevel gear
141 first switch
142 mounting shaft
143 first operating member
143*a* operating member body
143*b* lever
143*c* torsion spring
143*d* upper end portion
143*e* horn-like projection
144 fulcrum
145 second operating member
145*a* push button
145*b* upper end
145*c* shaft
146 second switch
147 spring
148 screw
149 receiving member
149*a* claw
149*b* U-shaped receiving portion
151 operation mode switching dial (operation mode switching member)
151*a* rotation axis
152 eccentric shaft
153 slide plate
153*a* rear end projection
153*b* slot
153*c* opening
153*d* columnar guide
153*e* rear edge
154 coil spring
155 linkage
155*a* columnar guide
157 connecting part
159 engagement slot
159*a* rear engagement surface
159*b* front engagement surface
159*c* escape recess
161 vibration-absorbing coil spring (vibration-proofing cushioning material)
163 pivot
165 bellows
167 light
170 control circuit
171 controller
172 circuit power supply section
173 switch detecting circuit
174 computing/driving section
175 motor control circuit power supply section
176 motor control section
177 drive circuit

The invention claimed is:

1. A power tool with several operation modes comprising:
a motor,
a tool body that houses the motor,
a tool bit mounting part which is provided on the tool body and to which an elongate tool bit to be driven by the motor is coupled,
a handle held by a user and disposed on the tool body at a side opposite to the tool bit mounting part in an axial direction of the tool bit,
a first switch and a second switch, each of which can be placed in an on state or an off state and
a control device that controls the motor, wherein the control device including:
a switch detecting section that detects the on or off state of each of the first and second switches when power is on,
an operation mode determining section that determines an operation mode based on the on or off state of each of the first and second switches, as detected by the switch detecting section and
a drive control section that, after the operation mode determining section determines the operation mode, outputs a drive control signal to the motor when the switch in the off state is turned on.

2. The power tool as defined in claim 1 comprising an operation mode switching member which can switch between the operation modes by manual operation of a user, wherein the operation modes include a first hammer mode and a second hammer mode for hammering operation in which the tool bit is caused to perform linear striking movement, and in the first hammer mode, by manual operation of the operation mode switching member, the second switch is held in the on state and the first switch is allowed to be turned to the on or off state, while, in the second hammer mode, by manual operation of the operation mode switching member, the first switch is held in the on state and the second switch is allowed to be turned to the on or off state.

3. The power tool as defined in claim 2, comprising a first operating member which is normally biased toward an off position by a biasing member and which is depressed to an on position against a biasing force of the biasing member in order to turn on the first switch, wherein the handle has a first housing space in which the first operating member can be housed and the first operating member is housed in the first housing space in the state in which the first switch is held in the on state by manual operation of the operation mode switching member in the second hammer mode.

4. The power tool as defined in claim 2, comprising a second operating member which is repeatedly pressed with user's finger in order to turn the second switch on and off, wherein the tool body has a second housing space in which the second operating member can be housed and the second operating member is housed in the second housing space in the state in which the second switch is held in the on state by manual operation of the operation mode switching member in the first hammer mode or the hammer drill mode.

5. The power tool as defined in claim 4, wherein the second switch comprises an electronic switch which energizes and de-energizes the motor by electric signals generated upon pressing operation of the second operating member.

6. The power tool as defined in claim 1, comprising an operation mode switching member which can switch between the operation modes by manual operation of a user, wherein the operation modes include a hammer drill mode for hammer drill operation in which the tool bit is caused to perform linear striking movement and rotation in the circumferential direction of the bit, and in the hammer drill mode, by manual operation of the operation mode switching member, the second switch is held in the on state and the first switch is allowed to be turned to the on or off state.

7. The power tool as defined in claim 1, wherein the operation modes include a mode in which the tool bit is caused to rotate and a mode in which the tool bit is not caused to rotate, and a process of switching between these modes includes a switching process in which both of the first and second switches are placed in the off state.

8. The power tool as defined in claim 1, comprising an indicating section that indicates by illumination which one of the operation modes is currently selected.

9. The power tool as defined in claim 8, wherein the indicating section indicates the current operation mode based on the on-off state of the second switch.

10. The power tool as defined in claim 1, comprising a vibration-proofing cushioning material which is disposed between the tool body and the handle and connects the tool body and the handle such that the tool body and the handle can move with respect to each other in the axial direction of the tool bit.

11. The power tool as defined in claim 1, comprising a first operating member which is normally biased toward an off position by a biasing member and which is depressed to an on position against a biasing force of the biasing member in order to turn on the first switch, and a second operating member which is repeatedly pressed with user's finger in order to turn the second switch on and off, wherein the first operating member is disposed on the tool bit mounting part side of the handle and the second operating member is disposed in a region of the tool body which faces the first operating member.

* * * * *